US007482902B2

(12) United States Patent
Kampf et al.

(10) Patent No.: US 7,482,902 B2
(45) Date of Patent: Jan. 27, 2009

(54) LINEAR MAGNETIC DRIVE

(75) Inventors: Marcus Kampf, Berlin (DE); Carsten Protze, Dresden (DE)

(73) Assignee: Siemens Aktiengesellschaft, Munich (DE)

( * ) Notice: Subject to any disclaimer, the term of this patent is extended or adjusted under 35 U.S.C. 154(b) by 315 days.

(21) Appl. No.: 10/546,759

(22) PCT Filed: Jan. 27, 2004

(86) PCT No.: PCT/DE2004/000159

§ 371 (c)(1),
(2), (4) Date: Aug. 25, 2005

(87) PCT Pub. No.: WO2004/077477

PCT Pub. Date: Sep. 10, 2004

(65) Prior Publication Data

US 2006/0139135 A1 Jun. 29, 2006

(30) Foreign Application Priority Data

Feb. 26, 2003 (DE) ..... 103 09 697

(51) Int. Cl.
*H01F 7/08* (2006.01)

(52) U.S. Cl. ..... 335/229; 335/220; 310/32

(58) Field of Classification Search ..... 335/220–229, 335/177, 179; 251/129.15; 310/32
See application file for complete search history.

(56) References Cited

U.S. PATENT DOCUMENTS 4,316,167 A 2/1982 Koehler
4,422,060 A * 12/1983 Matsumoto et al. ..... 335/256
4,533,890 A * 8/1985 Patel ..... 335/234
4,870,306 A * 9/1989 Petersen ..... 310/12
4,928,028 A * 5/1990 Leibovich ..... 310/23
5,394,131 A 2/1995 Lungu
6,020,567 A * 2/2000 Ishikawa et al. ..... 218/154
6,334,413 B1 * 1/2002 Hattori et al. ..... 123/90.11
6,373,675 B1 4/2002 Yamazaki et al.
6,512,435 B2 * 1/2003 van Namen ..... 335/234

(Continued)

FOREIGN PATENT DOCUMENTS

DE 39 42 542 A1 6/1991

(Continued)

OTHER PUBLICATIONS

Dulini E: "A vaccum circuit-breaker with permanent magnetic actuator for frequent operations" Discharges and Electrical Insulation in Vacuum, 1998. Proceedings ISDEIV. XVIIIth International Symposium on Eindhoven, Netherlands Aug. 17-21, 1998, New York, NY, USA IEEE, US Aug. 17, 1998, pp. 688-691, XP10318444, ISBN: 0-7803-3953-3, figure 3.

*Primary Examiner*—Elvin G Enad
*Assistant Examiner*—Bernard Rojas
(74) *Attorney, Agent, or Firm*—Laurence A. Greenberg; Werner H. Stemer; Ralph E. Locher

(57) ABSTRACT

The invention relates to a linear magnetic drive consisting of an iron core and a coil. A yoke and a constant magnet are connected to a movable armature. When the armature is placed in a first terminal position, it is supported by magnetic forces produced by the constant magnet and the yoke which is used as a bridge in the iron bore.

8 Claims, 3 Drawing Sheets

U.S. PATENT DOCUMENTS

| | | | | |
|---|---|---|---|---|
| 6,642,825 | B2 * | 11/2003 | Ohya | 335/229 |
| 6,888,269 | B1 | 5/2005 | Arndt et al. | |
| 2005/0046531 | A1 * | 3/2005 | Moyer et al. | 335/256 |

FOREIGN PATENT DOCUMENTS

| | | | |
|---|---|---|---|
| DE | 195 09 195 | A1 | 9/1996 |
| DE | 199 29 572 | A1 | 1/2001 |
| DE | 101 32 553 | A1 | 1/2003 |
| DE | 103 09 697 | B3 | 9/2004 |
| EP | 0 867 903 | A2 | 3/1998 |
| JP | 2000164059 | A | 6/2000 |
| JP | 2000268683 | A | 9/2000 |
| JP | 2002319504 | A | 10/2002 |
| NL | C 100 60 87 | | 2/1999 |

* cited by examiner

LINEAR MAGNETIC DRIVE

CLAIM FOR PRIORITY

This application claims the benefit of priority to German Application No. 103 09 697.3 which was filed in the German language on Feb. 26, 2003, the contents of which are hereby incorporated by reference.

TECHNICAL FIELD OF THE INVENTION

The invention relates to a linear magnetic drive having a first iron core, which passes through a first coil (to which current can be applied) and has at least one magnetic gap through which magnetic flux can pass, and having a moveable armature which has a first permanent magnet.

BACKGROUND OF THE INVENTION

A linear magnetic drive such as this is known, for example, from European Patent Application EP 0 867 903 A2. The linear drive in that document is used to move a contact piece of an electrical switch. A moveable armature has a permanent magnet which, when current flows through an electrical coil, moves in the direction of the coil as a result of the magnetic forces which act between the permanent magnet and the coil through which current is passing. This movement is used to switch on an interrupter unit for the circuit breaker. During the switching-on movement, spring packs are stressed. In order to hold the drive in its switched-on position even after interruption of the current flowing through the coil, the permanent magnet adheres to an iron core.

The invention is based on the object of designing a linear magnetic drive of the type mentioned initially so as to allow reliable positioning of the armature in a limit position, with a simplified design.

In the case of a linear magnetic drive of the type mentioned initially, the object is achieved according to the invention in that in a first limit position of the armature, the first permanent magnet at least partially fills a gap in the first iron core, and a yoke, which is arranged on the armature, rests on one edge of a gap in the first iron core.

A magnetic flux can be carried within the first iron core with low magnetic reluctance. In this case, an iron core may be composed of various suitable materials which have ferromagnetic characteristics (for example iron, cobalt, nickel, core laminates composed of specific alloys). The at least partial filling of a gap in the first iron core by means of a permanent magnet allows the magnetic lines of force which originate from the permanent magnet to pass into the first iron core with low losses. The fact that the yoke rests on the edge of a gap improves the guidance of the magnetic flux, because the magnetic flux is also guided within the yoke. The reluctance results in a force being produced. The effect of the force is particularly high when the distance between the yoke and the iron core is as short as possible. In this case, it is possible on the one hand to provide for the gap which is filled by the permanent magnet as well as the gap on whose edge the yoke rests to be one and the same gap, or else to be different gaps from one another. The magnetic flux which is produced within the first iron core is strong enough that the armature is held in its limit position. It can be moved away only by an externally acting force, or by current flowing through the coil.

Furthermore, it is advantageously possible to provide for the first iron core to comprise at least two sections between which the gap or gaps is or are formed through which the magnetic flux which can be produced in the first iron core can flow.

The splitting of the iron core into at least two sections allows advantageous guidance of the magnetic flux in the interior of the first iron core. For example, the iron core may be formed integrally, with the iron core itself being subdivided into a plurality of sections by an appropriate arrangement of incisions. The incisions can then be regarded as gaps, in which, for example, the first permanent magnet is moved with the armature. The subdivision into a plurality of sections means that particular areas can be formed deliberately on the iron core, on which the magnetic flux runs in preferred directions, for example in order to allow it to enter or emerge at right angles to a surface.

It is also advantageously possible to provide for the first iron core to be formed in at least two parts, and for pole surfaces to be in each case arranged on a first core body and on a second core body of the first iron core, between which pole surfaces a first and a second gap are formed.

Subdivision of the first iron core into a plurality of core bodies allows the first iron core to be assembled in a modular form. Thus, depending on the requirements, different iron cores can be formed from a small number of core bodies. For example, it is possible to use two identical core bodies, between which a first and a second gap are formed. In one simple case, the two core bodies are in the form of U-cores, with the free ends of the limbs being arranged opposite one another at the ends. The end faces of the limbs then form the pole surfaces.

A first and a second gap are in each case formed between the pole surfaces. An iron core such as this is extremely robust and can be produced at low cost. The limbs of the unshaped core bodies are suitable for holding the first coil, to which current can be applied, and for use as stop points for the yoke.

A further advantageous refinement can provide for the yoke to be held by the magnetic flux which originates from the first permanent magnet, when the armature is in the first limit position.

The use of the magnetic flux for holding the armature means that there is no need to use mechanical latching mechanisms. This magnetic "latching mechanism" is virtually free of any mechanical wear. Owing to the use of a permanent magnet, no auxiliary power resources whatsoever are required in order to hold the armature permanently in the first limit position.

A further advantageous refinement can provide for the magnetic force which is produced by the magnetic flux to be opposed in the first limit position by a force which originates from an additional element.

An additional element may, for example, be an elastic element which is stressed during movement of the armature to the first limit position. Elastic elements are, for example, springs, hydraulic mechanisms, pneumatic mechanisms, etc. The armature holding force which is produced by the magnetic flux is in this case greater than the force which originates from the elastic element. The force which is provided by the elastic element is now available in order to move the armature away from the first limit position. The external force which is required to initiate a movement of the armature away from the first limit position need in this case have only a magnitude which is greater than the difference between the magnetic force and the force which originates from the elastic element. For example, the external force can be produced by current flowing through the electrical coil. A design such as this means that, irrespective of the magnitudes of the magnetic force and of the force which originates from the elastic element, it is possible to move the armature from the first limit position with a relatively small external force, which is dependent only on the force difference. The force which is required for complete movement of the armature is provided by the elastic element. Only small external switching-off forces are therefore required even for very high-power linear magnetic drives.

Furthermore, it is advantageously possible to provide for the first coil to have the capability to produce a magnetic field which passes through the gap transversely with respect to the movement direction of the armature.

By way of example, a magnetic field which is aligned transversely with respect to the movement direction of the armature can be produced by winding the coil on one limb of a u-shaped core body. This means that the coil can itself be replaced very easily, with the effect of the magnetic field which is produced by the first coil being directly amplified by the iron core. In this case, by way of example, it is also possible to provide for the coil to extend on two opposite faces of a gap in the iron core. This results in a symmetrical force being produced on the gap and on the permanent magnets. In this case, the magnetic field in the gap can preferably run at right angles to the movement direction of the armature.

A further refinement can advantageously provide for the armature to have a second permanent magnet, which interacts with a second iron core which passes through a second coil (to which current can be applied) and has at least one magnetic gap through which a magnetic flux can pass, wherein a magnetic gap in the second iron core is at least partially filled by the second permanent magnet in a second limit position of the armature, and the yoke rests on one edge of a magnetic gap in the second iron core.

The use of an armature with two permanent magnets and a yoke makes it possible to hold the armature securely in two limit positions. In this case, the magnetic flux which is produced by the first or by the second permanent magnet can be used to produce the holding forces. Furthermore, the use of the first and of the second coil means that the forces which are available for movement of the armature can be amplified in a simple manner. One or both coils can produce a force acting on the armature, depending on the winding sense and the direction of the current flow in the two coils. Depending on the design, it is thus possible to increase the drive power or to use two physically smaller coils to produce the same drive power as with a single coil. It is also possible to dispense with the elastic elements which produce a restoring force. However, it is also possible to provide for elastic elements still to be used in order, for example, to provide an emergency switching capability, braking or additional acceleration of the armature.

Furthermore, it is advantageously possible to provide for the yoke to rest on one edge of a gap in the first iron core in the first limit position, and to rest on one edge of a gap in the second iron core in the second limit position.

In addition to the production of the holding forces in the first limit position and in the second limit position, the yoke is used as a mechanical stop on the first iron core and on the second iron core. This limits the movement distance of the armature. The yoke can be designed to be sufficiently mechanically robust to absorb stopping and striking forces. The iron cores as well as the yoke, as load-bearing elements, are mechanically robust and keep vibration away from the coils.

It is also advantageously possible to provide for a drive which has the features as claimed in one of claims 1 to 6 to be designed with mirror-image symmetry with respect to a mirror-image axis.

A design with mirror-image symmetry allows the drive to be designed in a modular form, and allows the use of identical assemblies in this case. The mirror-image axis may, for example, be parallel to or coincident with the movement axis of the armature, which can be moved linearly. A further advantageous mirror-image axis may, for example, be an axis which is at right angles to the movement direction of the armature. A configuration such as this makes it possible to design the first and the second iron core in the same way. This makes it possible to produce drives of different shapes with a small number of components.

BRIEF DESCRIPTION OF THE DRAWINGS

The invention will be described in more detail in the following text with reference to an exemplary embodiment, and is illustrated schematically in the drawing, in which.

DETAILED DESCRIPTION OF THE INVENTION

Figure 1:
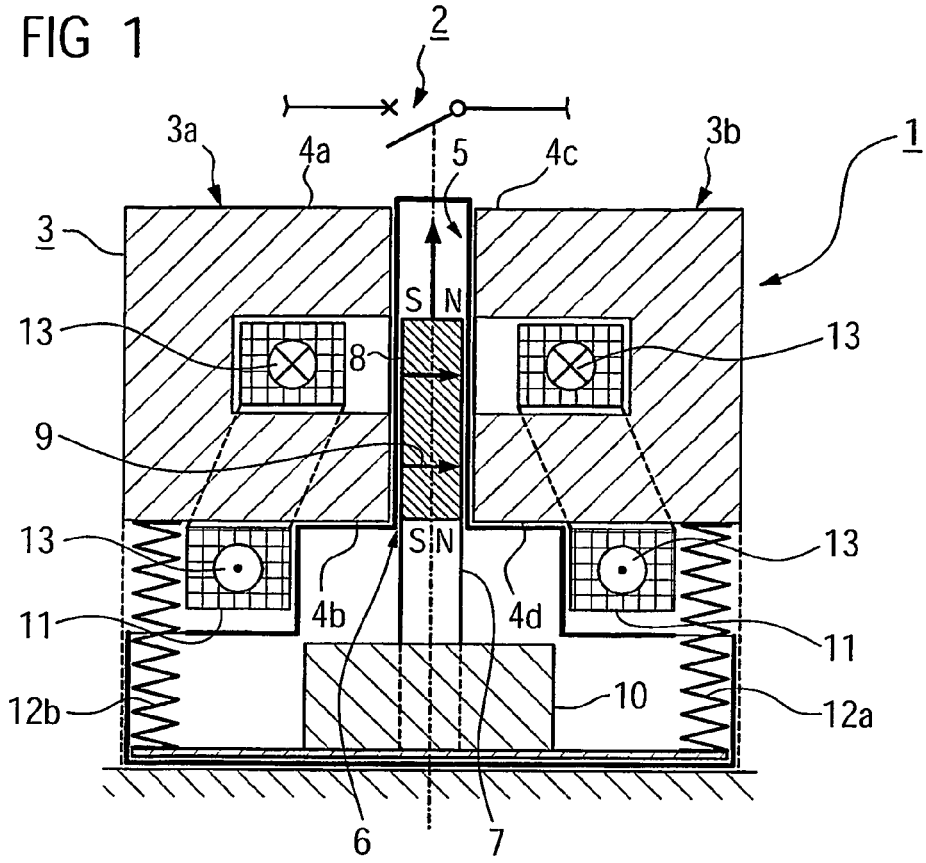
FIG. 1 shows a first variant of a linear magnetic drive in a first switch position.

FIG. 1 shows a first embodiment variant of a linear magnetic drive 1. The linear magnetic drive 1 is used to move a switching contact of an electrical switching device 2. The electrical switching device 2 may, for example, be a multipole circuit breaker which has vacuum interrupters. The linear magnetic drive 1 has a first iron core 3. The first iron core 3 has a first core body 3*a* as well as a second core body 3*b*. The first core body 3*a* and the second core body 3*b* are designed identically. The core bodies 3*a*, 3*b* are in the form of unshaped core bodies and are arranged with respect to one another such that the free limbs of the core bodies 3*a*, 3*b* are arranged with their ends opposite one another. The first core body 3*a* has a first limb 4*a* and a second limb 4*b*. The second core body 3*b* has a first limb 4*c* and a second limb 4*d*. The end faces of the first limbs 4*a*, 4*c* are in the form of pole surfaces, and bound a first gap 5. A second gap 6 is formed on the end faces of the second limbs 4*b*, 4*d*, between their pole surfaces. An armature 7 can move between the first gap 5 and the second gap 6. The armature 7 has a first permanent magnet 8. The north and south poles (NS) of the first permanent magnet 8 are in this case arranged such that the lines of force 9 which run in the interior of the first permanent magnet 8 can enter the pole surfaces of the first limbs 4*a*, 4*c* and of the second limbs 4*b*, 4*d* virtually at right angles. The armature 7 also has a yoke 10. The yoke 10 is mounted on a side of the armature 7 facing away from the switching device 2, at a distance from the first permanent magnet 8. The connection of the first permanent magnet 8 to the yoke 10 is formed from a non-magnetic material. The second limbs 4*b*, 4*d* are used as a winding core for a first coil 11. Alternatively, it is also possible to provide for the first coil 11 to be wound on the first limbs 4*a*, 4*c*. The first coil 11 extends on both sides of the movement axis of the armature 7. A spring packet 12*a,b* is arranged as an elastic element on the first iron core 3 and can be compressed during movement of the armature 7.

FIG. 1 shows the linear magnetic drive 1 in the off position, that is to say in the position in which the contacts of the electrical switching device 2 are open. The armature 7 is held stable in its off position by means of the prestressed spring pack 12*a,b*. The off position defines a second limit position of the armature 7. The first permanent magnet 8 bridges the second gap 6, and fills it. When direct current is flowing through the first coil 11 in a first direction (13), the force which is produced between the magnetic field of the first permanent magnet 8 and the magnetic field of the first coil 11 results in the armature 7 moving in the direction of the first gap 5. Additional force is produced during the movement by the reduction in the distance between the yoke 10 and the first iron core 3.

Figure 2:
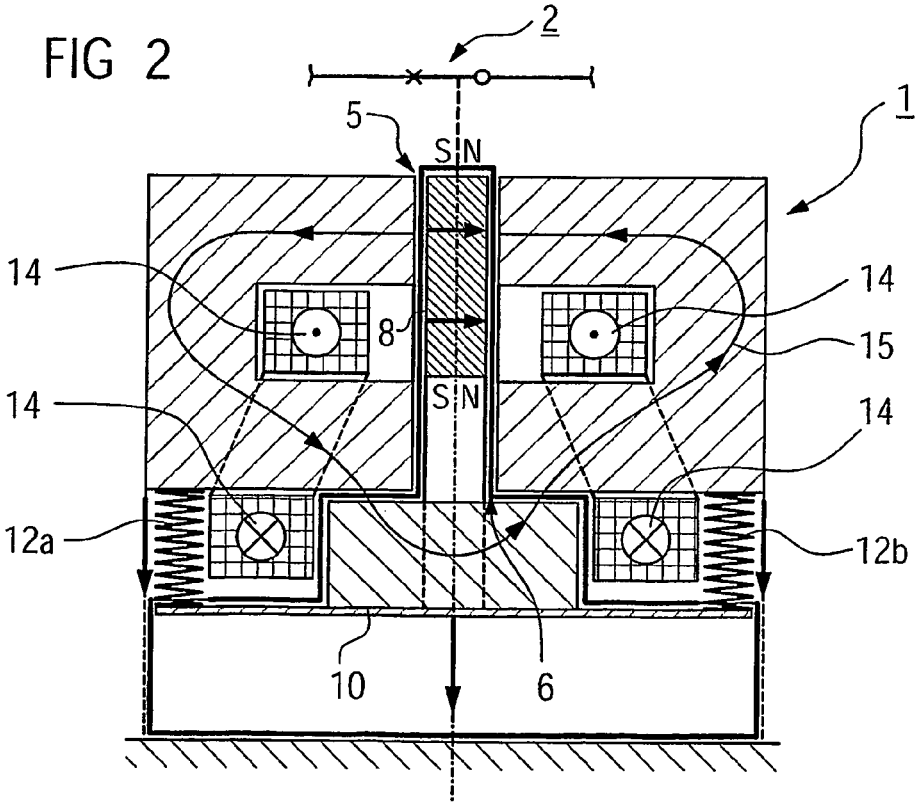
FIG. 2 shows the first variant of a linear magnetic drive in a second switch position.

FIG. 2 shows the armature 7 in the first limit position, in which the first permanent magnet 8 bridges the first gap 5. The contacts of the electrical switching device 2 are now closed, and the spring pack 12*a,b* is stressed. The yoke 10 rests flat against the edge of the second gap 6. The yoke 10 bridges the second gap 6. The magnetic flux 15 which originates from the first permanent magnet 8 is now carried in the first core body 3*a* and in the second core body 3*b*, and the magnetic flux path is closed via the yoke 10. The magnetic force which is produced by the first permanent magnet 8 holds the armature 7 stable in the first limit position. The linear magnetic drive 1 acts as a drive which is fed from a permanent magnet.

Current has to flow through the first coil in a second direction 14 in order to move the armature 7 from the first limit position (FIG. 2) to a second limit position (FIG. 1). Alternatively, it is possible to provide for an additional coil to be used to produce a switching-off movement. By way of example, it is possible to produce a specific movement sequence for the armature 7 during a switching-off process. Assisted by the stressed spring pack 12*a,b*, the first permanent magnet 8 is moved away from the first limit position. The armature 7 as well as the yoke 10 are also moved with it.

In the first limit position (FIG. 2), the armature 7 is held stable by the magnetic flux which originates from the first permanent magnet 8. The armature 7 is held stable in the second limit position (FIG. 1) by the spring pack 12*a,b*.

Figure 3:
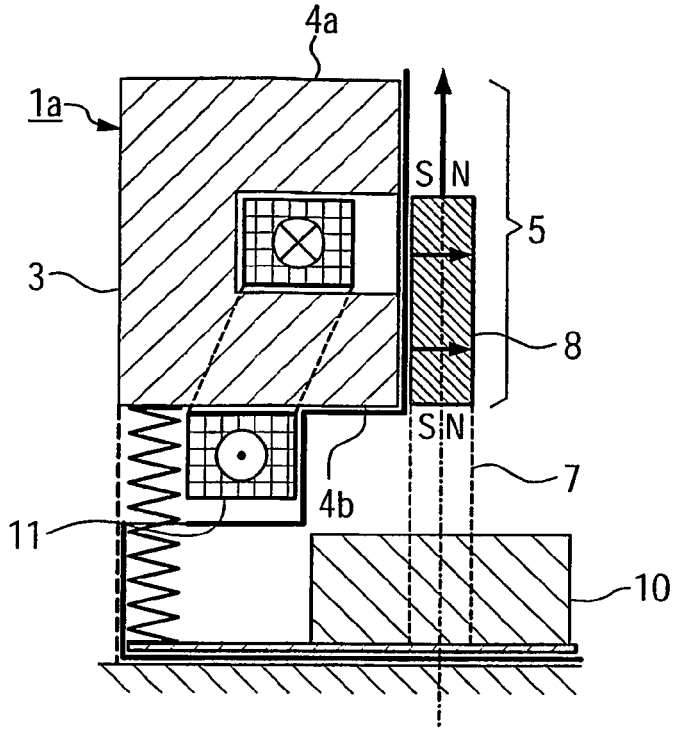
FIG. 3 shows a modification of the first variant of a linear magnetic drive.

FIG. 3 shows a modification of the variant of a linear magnetic drive as illustrated in FIGS. 1 and 2. FIG. 3 shows a linear magnetic drive 1*a* which has an integral first iron core 3. The first iron core 3 is u-shaped. A first coil 11 is wound on one of the limbs. A first gap 5 is formed between the pole surfaces which are located at the end on the first limb 4*a* and on the second limb 4*b*. A first permanent magnet 8 can move within the first gap 5. The first permanent magnet 8 is arranged on an armature 7. The armature 7 also has an associated yoke 10. After movement of the armature 7 to a first limit position (not illustrated), the yoke 10 is supported on the second limb 4*b*. The second limb 4*b* forms an edge of the first gap 5. The fact that the yoke 10 makes contact over an area shortens the path length of the lines of force, which originate from the first permanent magnet 8, via the first iron core 3 and the yoke 10, so that the armature 7 is held stable in the first limit position by the magnetic force that is produced by the permanent magnet 8. Current must be passed through the first coil 11 in opposite directions in each case in order to move the armature 7 from the second limit position to the first limit position, and vice versa.

The method of operation of the arrangement illustrated in FIG. 3 corresponds to the method of operation of the linear magnetic drive which is illustrated in FIGS. 1 and 2 and has been described above.

Figure 6:
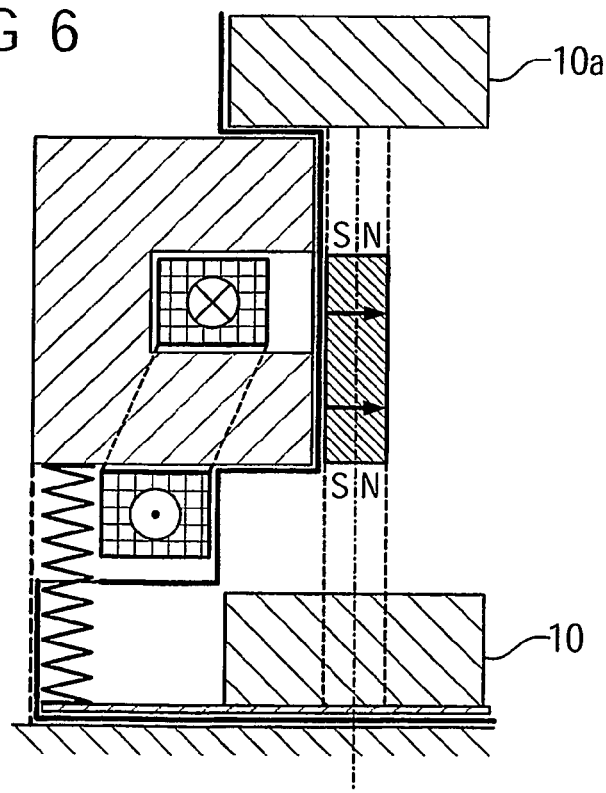
FIG. 6 shows a modification of the first variant of a linear magnetic drive with a further yoke.

FIG. 6 shows a linear magnetic drive as is in principle known from FIG. 3. The armature 7 has a further yoke 10*a* in addition to the yoke 10. The yokes 10, 10*a* are used to bear the armature 7 in a stable form in the limit positions.

Figure 4:
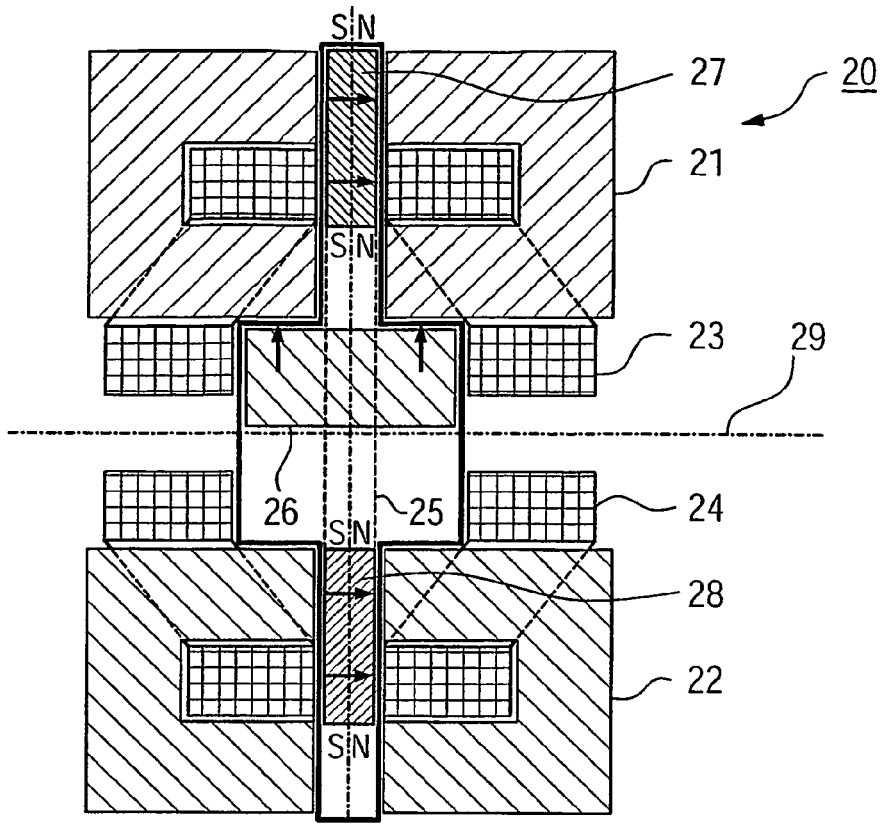
FIG. 4 shows a second variant of a linear magnetic drive in a first switch position.
Figure 5:
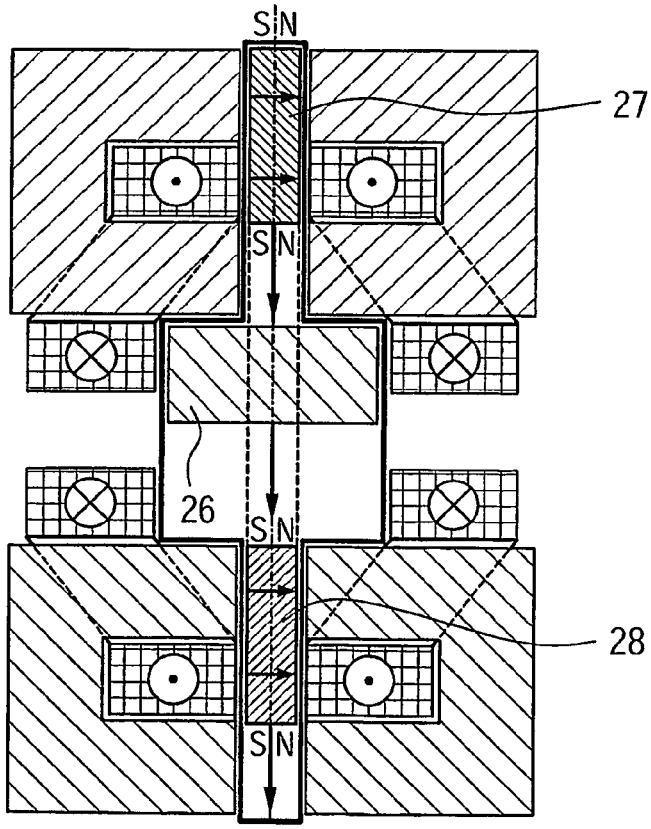
FIG. 5 shows the second variant of a linear magnetic drive at the start of movement from the first switch position to a second switch position.

FIGS. 4 and 5 show a second variant of a linear drive according to the invention. A double linear magnetic drive 20 as illustrated in FIGS. 4 and 5 has a first iron core 21 as well as a second iron core 22, each having two core bodies. The configuration of the first iron core 21 and of the second iron core 22 corresponds to the configuration of the iron core illustrated in FIGS. 1 and 2. The first iron core 21 has an associated first coil 23. The second iron core 22 has an associated second coil 24. The first coil 23 and the second coil 24 are arranged on free limbs of the iron cores. The double linear magnetic drive 20 has an armature 25, to which a yoke 26 is attached centrally. The armature 25 is in a linear extended form and, at its ends, has a first permanent magnet 27 and a second permanent magnet 28. The first iron core 21, the first coil 23 and the first permanent magnet 27 interact in the same way as the second iron core 22, the second coil 24 and the second permanent magnet 28 (as described above with reference to FIGS. 1 and 2). The mirror-image configuration with respect to its axis of symmetry 29 as well as the shape of the armature 25 mean that both the first coil 23 and the second coil 24 can be used for movement of the armature 25 from a first limit position to a second limit position, and vice versa. In the same way as described with reference to FIG. 1 and FIG. 2, the yoke 26 in each case acts as a bridge for a gap in the first iron core 21 or in the second iron core 22, and positions the armature 25 in its limit positions using the magnetic holding forces which are produced by the respective permanent magnets 27, 28. Expressed in simple terms, the spring pack 12*a,b* which is provided in order to produce a restoring movement in FIGS. 1 and 2 is replaced by an arrangement having a second iron core 22, a second coil and a second permanent magnet 28.

All of the features of the examples illustrated in the figures can be combined with one another, thus resulting in further variations.

The invention claimed is:

1. A linear magnetic drive, comprising:

a first coil for obtaining a current;

a first iron core passing through said first coil, said first iron core formed with at least one magnetic gap allowing a magnetic flux to pass through said gap; and a moveable armature including a first permanent magnet and a yoke;

said gap of said first iron core defining an edge of said first iron core;

said armature being moveable to a first limit position in which said first permanent magnet at least partially fills said gap of said first iron core and said yoke rests on said edge of said first iron core; and said armature being moveable in a movement direction, and said first coil producing a magnetic field passing through said gap transversely with respect to the movement direction of said armature;

wherein said first permanent magnet provides a magnetic flux that holds said yoke when said armature is in the first limit position.

2. The linear magnetic drive according to claim 1, wherein said first iron core includes at least two sections, and said gap of said first iron core is formed between said two sections.

3. The linear magnetic drive according to claim 2, further comprising a first gap and a second gap, wherein:

said first iron core is formed in at least two parts;

said first iron core includes a first core body and a second core body;

said first core body is formed with at least a first pole surface and a second pole surface;

said second core body is formed with at least a first pole surface and a second pole surface;

said gap is formed between said first pole surface of said first core body and said first pole surface of said second core body; and said second gap is formed between said second pole surface of said first core body and said second pole surface of said second core body.

4. The linear magnetic drive according to claim 1, further comprising an additional element for providing a force, wherein in the first limit position, the magnetic flux produces a magnetic force that acts against the force from said additional element.

5. The linear magnetic drive according to claim 1, further comprising:

a second coil for obtaining a current; and a second iron core passing through said second coil, said second iron core formed with at least one magnetic gap allowing passage of a magnetic flux;

said armature including a second permanent magnet interacting with said second iron core;

said gap of said second iron core defining an edge of said second iron core; and said armature being moveable to a second limit position in which said second permanent magnet at least partially fills said gap of said second iron core and said yoke rests on said edge of said second iron core.

6. The linear magnetic drive according to claim 5, wherein the drive is designed with mirror-image symmetry with respect to a mirror-image axis.

7. The linear magnetic drive according to claim 1, wherein said magnetic field, which passes through said gap transversely with respect to the movement direction of said armature, generates a force moving said armature in the movement direction.

8. The linear magnetic drive according to claim 1, wherein:

said first permanent magnet includes an interior, a north pole, and a south pole; and said north pole and said south pole of said first permanent magnet generate a magnetic field in said interior of said first permanent magnet that runs transversely to the movement direction of said armature.

* * * * *